US006112824A

United States Patent [19]

Liliedahl et al.

[11] Patent Number: 6,112,824

[45] Date of Patent: Sep. 5, 2000

[54] ARRANGEMENT FOR EXTINGUISHING OF FIRES IN MOTOR ROOMS, VEHICLES OR SIMILAR SPACES

[75] Inventors: Nils Liliedahl, Mölndal; Kid Svala, Hindås; Karl Bergqvist, Harestad, all of Sweden

[73] Assignee: AB Volvo, Göteborg, Sweden

[21] Appl. No.: 09/214,220

[22] PCT Filed: May 22, 1997

[86] PCT No.: PCT/SE97/00837

§ 371 Date: Dec. 30, 1998

§ 102(e) Date: Dec. 30, 1998

[87] PCT Pub. No.: WO98/00199

PCT Pub. Date: Jan. 8, 1998

[30] Foreign Application Priority Data

Jul. 3, 1996 [SE] Sweden ..... 9602628

[51] Int. Cl.[7] ..... A62C 3/07; A62C 35/00

[52] U.S. Cl. ..... 169/62; 169/70

[58] Field of Search ..... 169/62, 70, 54, 169/48, 26

[56] References Cited

U.S. PATENT DOCUMENTS

| | | | |
|---|---|---|---|
| 3,336,153 | 8/1967 | Juda | 169/48 X |
| 4,100,970 | 7/1978 | Kreske, Jr. | 169/26 X |
| 5,269,378 | 12/1993 | Maas et al. . | |
| 5,413,838 | 5/1995 | Azuma et al. . | |
| 5,508,321 | 4/1996 | Brebner . | |
| 5,678,638 | 10/1997 | Baker | 169/62 X |

FOREIGN PATENT DOCUMENTS

| | | | |
|---|---|---|---|
| 2 254 182 | 7/1975 | France . | |
| 35 42 326 C1 | 1/1987 | Germany . | |
| 6-24453 | 2/1994 | Japan . | |
| 2231905 | 11/1990 | United Kingdom | 169/54 |

*Primary Examiner*—Lesley D. Morris

*Attorney, Agent, or Firm*—Royston, Rayzor, Vickery, Novak & Druce, L.L.P.

[57] ABSTRACT

Apparatus is disclosed for extinguishing fires in engine compartments and the like including a layer of polymeric material disposed within the engine compartment, the polymeric material being expandable on exposure to localized elevated temperatures and being disposed at predetermined locations within the engine compartment so that upon exposure to localized elevated temperatures the polymeric material expands to extinguish the fires produced thereby.

13 Claims, 1 Drawing Sheet

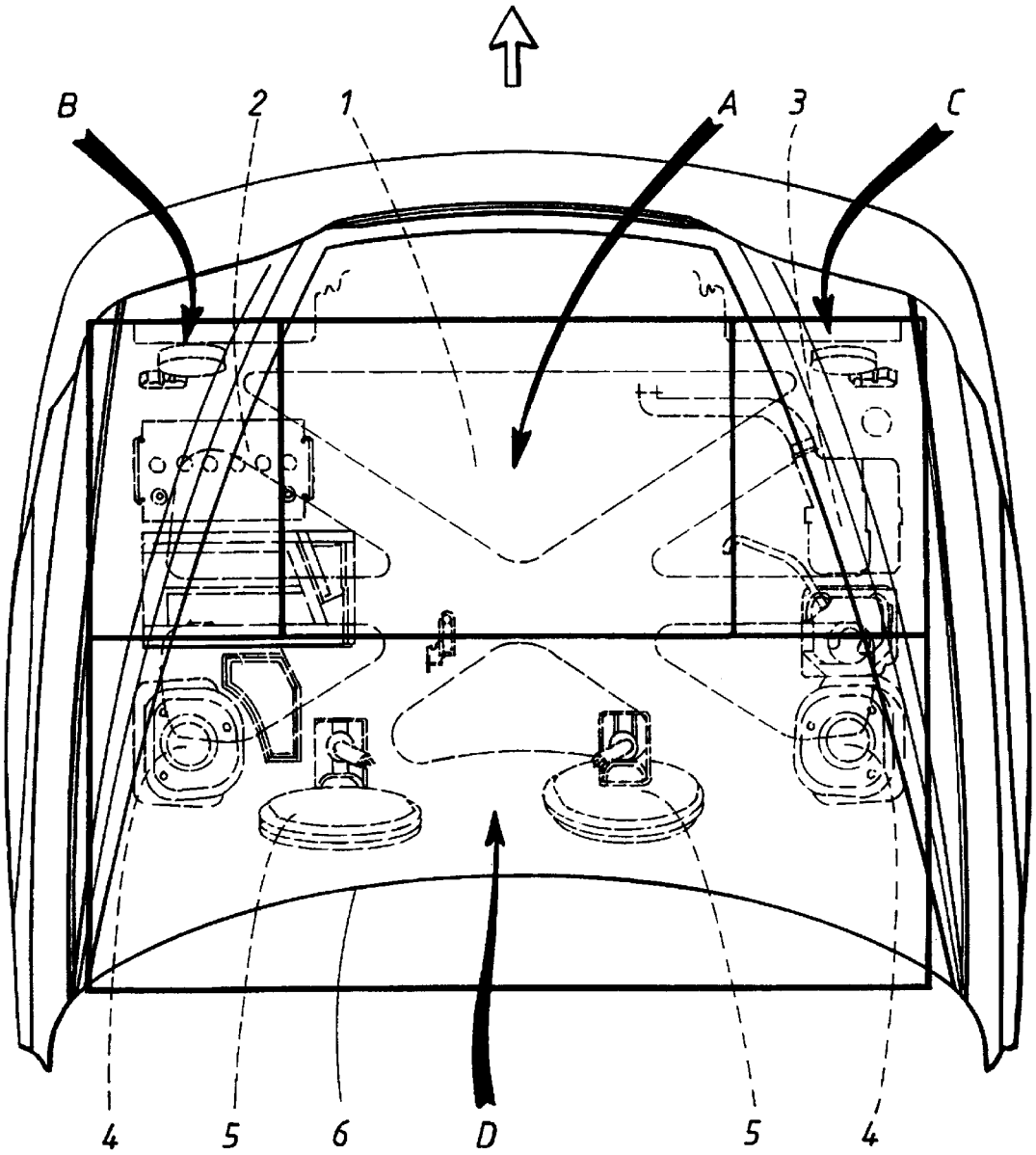
B
2
1
A
3
C
4
5
6
D
5
4

ARRANGEMENT FOR EXTINGUISHING OF FIRES IN MOTOR ROOMS, VEHICLES OR SIMILAR SPACES

FIELD OF THE INVENTION

The present invention relates to an arrangement for extinguishing fires, especially such fires which are created in engine compartments in vehicles or in similar spaces, which may be stationary and which are not too large.

BACKGROUND OF THE INVENTION

It is known that fires occur, albeit to a small extent, in engine compartments in vehicles and similar spaces without necessarily being caused by an accident. This is true for all kinds of vehicles, including cars of different sizes, both private cars and transport vehicles from different manufacturers, and other types of vehicles. Car fires are especially serious when fuel participates in the combustion process, and it is usually difficult to restrict such car fires before the whole car has burned. It is usually difficult to establish the precise cause for these fires since the car or the vehicle has often completely burned. However, except in the case of accidents, it is generally presumed that some error in the electrical system, leakage of inflammable liquids, superheating of components, or a combination thereof causes these fires. The components present in the engine compartment have therefore usually been made as secure as possible with regard to fire, and arranged in such a way that fire will not break out. However, measures previously taken have not prevented fires from nevertheless occurring. If, in spite of the measures taken, such a fire breaks out, the only way to fight such a fire is usually by means of a fire extinguisher, which is handled manually and which is located at a suitable place in the car. No automatic fire control system exists in these engine compartments.

As mentioned above, fires may arise in an engine compartment due to electrical faults, fuel leakage or the like. Fires may also arise in different parts of the engine compartment, for example in the forward part of the compartment as viewed in the direction in which the vehicle generally moves. This forward part is relatively cold. The fire may also arise in the rear part which has a higher temperature. The electrical components are usually placed in the cooler parts of the engine compartment and a fire in these parts differs in nature from a fire which has been caused, for example, by a fuel leakage, generally in the warmer part of the engine compartment. It is therefore desirable to provide for an automatic fire extinguishing system which can fight different types of fires in different parts of the engine compartment. The system should be divided into different zones in the engine compartment and accordingly aimed at extinguishing different types of fires.

There has therefore long been a desire to make it possible to build in a fire extinguishing system in an engine compartment or similar space, which is automatically released and extinguishes the fire in its infancy, and which is tailor-made for different parts of the compartment.

SUMMARY OF THE INVENTION

In accordance with the present invention, these and other objects have now been realized by the invention of apparatus for extinguishing fires in substantially enclosed spaces which are normally subject to localized elevated temperatures and potential fires, the apparatus comprising a layer of a polymeric material disposed at a predetermined location within the substantially enclosed space, the polymeric material being expandable upon exposure to the localized elevated temperatures, and the predetermined location being selected with respect to the substantially enclosed space such that upon exposure to the localized elevated temperatures the polymeric material will expand so as to extinguish the fires produced by the localized elevated temperatures. In a preferred embodiment, the substantially enclosed space comprises an engine compartment of a vehicle.

In accordance with one embodiment of the apparatus of the present invention, the substantially enclosed space includes a preselected surface and an impregnatable material, the layer of polymeric material comprising a coating of the polymeric material applied to the preselected surface within the substantially enclosed space or impregnated into the impregnatable material within the substantially enclosed space.

In one embodiment, the polymeric material includes fire agents whereby upon exposure to the localized elevated temperatures the fire agents generate gases which are effective in retarding the fire created by the localized elevated temperatures. In another embodiment, the polymeric material is selected from the group consisting of phenol resin, urea resin, melamine resin, epoxy resin, polyurethane resin, and mixtures thereof. In accordance with a preferred embodiment, the fire agents are selected from the group consisting of halogens, carbonates or mixtures thereof. Preferably, the halogens are adapted to generate bromine, and in another preferred embodiment, the carbonates comprise calcium carbonate whereby the calcium carbonate generates carbon dioxide.

In accordance with another embodiment of the apparatus of the present invention, the impregnatable material comprises sound absorption material disposed within the engine compartment.

In accordance with another embodiment of the apparatus of the present invention, the engine compartment includes a CD plate defining a lower front portion of the engine compartment, and the CD plate comprises the preselected surface within the engine compartment.

In accordance with another embodiment of the apparatus of the present invention, the engine compartment includes a front portion with respect to the direction in which the vehicle normally moves and a rear section, the front section including at least one electrical-component-containing zone and the rear portion including at least one hot zone, and wherein the polymer material including the fire agents is included in the front zone and the polymer material adapted to produce substantial amounts of the expandable material is included in the rear zone. In a preferred embodiment, the rear zone includes a manifold. In another embodiment, the rear zone includes an intermediate partition between the engine compartment of the vehicle and a passenger compartment in the vehicle.

According to the present invention, a system for extinguishing fires in engine compartments in vehicles or similar enclosed spaces has been provided which includes coatings or impregnations on strategic locations of polymer material which expands considerably when heated, and preferably containing agents which when heated develop fire extinguishing or fire retardant gases.

According to the present invention, it is preferred that the polymer material comprise phenol resin, urea resin, melamine resin, epoxy resin and polyurethane resin, or mixtures thereof.

The agents which develop fire extinguishing or fire retardant gases can, according to the present invention, comprise halogens, such as those which, for example, develop bromine, carbonates, such as calcium carbonate, which develop carbon dioxide or mixtures thereof, but as far as possible agents which are less damaging to the environment should be used, for example ammonium phosphate.

A sound-absorbing material is usually positioned in an engine compartment, and according to the present invention it may be impregnated with the polymer material.

In addition, engine compartments are now generally delimited by a so-called CD plate between the engine compartment and the passenger compartment and according to the present invention it is suitable that this CD plate is coated with the expanding polymer material.

According to the present invention, the engine compartment may be divided into zones, and coatings or impregnations which, for instance, provide considerable gas development are arranged in the forward part of the engine compartment containing the electric or electronic zone, while coatings which produce a large amount of foam are arranged in hot zones at the rear of the engine, as seen in the direction of driving, for example, close to the manifold, the catalytic converter or on the intermediate board between the engine compartment and the passenger Compartment. It is of course possible to divide the engine compartment or similar spaces into as many zones as are needed to cover all fire hazardous areas.

BRIEF DESCRIPTION OF THE FIGURES

The present invention will now be described in more detail in connection with the following detailed description which refers to the drawing which, in a greatly simplified and schematic way, shows an engine compartment of a car having a transverse engine, and which is divided into different zones.

DETAILED DESCRIPTION

The FIGURE shows schematically the engine compartment as seen from above in a motor car having a transverse engine 1. The normal forward driving direction of the vehicle is shown by an arrow. At either side of the engine, electrical devices are arranged, for example a battery 2 and an electric junction box 3. Behind the engine the support means 4 for the front wheels and the brake boosters 5 are shown.

The engine compartment is, in this example, divided schematically into four zones by means of continuous heavy lines. Zone A consists of the engine and its immediate surroundings, whereas zones B and C, adjacent to zone A, comprise the electrical devices, such as the battery 2 and the junction box 3. These zones B and C are, in the present case, equal, and may be called electric zones, which are comparatively cool. Behind zone A there is a zone D which is a hot zone. This zone division is schematic and the limits between these zones are not necessarily straight lines. The division of these zones is different from one type of car to another.

The engine compartment in modern cars is usually tightly packed. This means that if a polymer material located in a certain zone is caused to foam it will surround and pack in a great number of parts so that the air is driven off therefrom and a possible fire is extinguished. This effect is improved upon by mixing the polymer material with a gas developing medium which develops a gas which is not combustible and which drives off the oxygen in the air.

Those places on which it is suitable to apply the polymer material of this invention are of course different from one type of car to another, but a preferable way is to impregnate the existing sound-absorbent mat under the hood with polymer material. If a fire breaks out somewhere in the engine, foam will therefore quickly sink down from this absorption mat and cover and extinguish the fire.

Other places which may be suitable for application of the polymer material hereof are on the inner side of the so-called CD plate, which is located in the lower forward part of the engine compartment, and on the intermediate board 6 between the engine compartment and the passenger compartment.

The polymer materials which is used in the different zones need not have the same composition. It can be suitable, for example, that zones 2 and 3, i.e. the electrical zones, are extinguished with gas, whereas zone D, the so-called heat zone, is to be filled with a polymer foam. A combination of gas and polymer foam is advantageous in all zones.

The polymer material shall, as mentioned above, be of the expanding type. An expansion of around 1000% is desirable but not strictly necessary. The thickness of a polymer coating which has been applied by coating or spraying will then suffice to fill the adjacent spaces to a fairly large extent. The temperature at which the polymer shall start expanding can be adapted, but should be in a region of from about 400 to 5000° C.

The manner in which the polymer material is applied is not critical. It may occur by impregnating the polymer material, which is in the form of a solution in the above-mentioned sound-absorption mass, whereafter the is evaporated, or the polymer mixture may be sprayed or coated onto the parts which are suitable. Such a coating may be only about one or a few millimetres thick, and is therefore barely visible. It is therefore very suitable to protect old or used cars against fire by using the present invention.

The preferred polymers which can be used in the present invention comprise phenol resin, urea resin, melamine resin, epoxy resin and polyurethane resin or mixtures thereof. Such polymers are disclosed in U.S. Pat. No. 5,269,378, which disclosure is incorporated herein by reference thereto, but are used for fire protection during other circumstances. Other useable materials are described in U.S. Pat. Nos. 5,508,321 and 5,413,838 and German Patent No. 3,542,326, which disclosures are incorporated herein by reference thereto.

The gas-developing agents which should be utilized are, in exceptional cases, those that develop halogen gases, such as bromine, or by carbon dioxide which is developed by heating of, for example, calcium carbonate. Other agents can also be used, so long as they develop non-combustible gases which drive off the oxygen in the air.

An advantage with the arrangement according to the present invention is that it can be reactivated if the fire should flare up again, in which case the remaining polymers and fire-retarding gases can be released so that the fire once again can be stifled.

A further advantage with the present invention is that the arrangement does not have any mechanical or electronic parts which can be disabled. The system is released at a predetermined temperature regardless of what error causes the situation. Due to the fact that the fire is stifled in its infancy, it will also be possible to determine the reason for the fire so that improvements and repairs can be carried out.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for extinguishing fires in substantially enclosed spaces which are normally subject to localized elevated temperatures and potential fires, said apparatus comprising a layer of a polymeric material disposed at a predetermined location within said substantially enclosed space, said polymeric material being expandable upon exposure to said localized elevated temperatures, and said predetermined location being selected with respect to said substantially enclosed space such that upon exposure to said localized elevated temperatures said polymeric material will expand so as to extinguish said fires produced by said localized elevated temperatures.

2. The apparatus of claim 1 wherein said substantially enclosed space comprises an engine compartment of a vehicle.

3. The apparatus of claim 2 wherein said substantially enclosed space includes a preselected surface and impregnatable material, said layer of polymeric material comprising a coating of said polymeric material applied to said preselected surface within said substantially enclosed space or impregnated into said impregnatable material within said substantially enclosed space.

4. The apparatus of claim 3 wherein said polymeric material includes fire agents whereby upon said exposure to said localized elevated temperatures said fire agents generate gases which are effective in retarding a fire created by said localized elevated temperatures.

5. The apparatus of claim 3 wherein said polymeric material is selected from the group consisting of phenol resin, urea resin, melamine resin, epoxy resin, polyurethane resin and mixtures thereof.

6. The apparatus of claim 4 wherein said fire agents are selected from the group consisting of halogens, carbonates, and mixtures thereof.

7. The apparatus of claim 6 wherein said halogens are adapted to generate bromine.

8. The apparatus of claim 6 wherein said carbonates comprise calcium carbonate whereby said calcium carbonate generates carbon dioxide.

9. The apparatus of claim 3 wherein said impregnatable material comprises sound absorption material disposed within said engine compartment.

10. The apparatus of claim 3 wherein said engine compartment includes a CD plate defining a lower front portion of said engine compartment, and wherein said CD plate comprises said preselected surface within said engine compartment.

11. The apparatus of claim 3 wherein said engine compartment includes a front portion with respect to the direction in which said vehicle normally moves and a rear section, said front section including at least one electrical component containing zone and said rear portion including at least one hot zone, and wherein said polymer material including said fire agents are included in said front zone and said polymer material adapted to produce substantial amounts of said expandable material are included in said rear zone.

12. The apparatus of claim 11 wherein said rear zone includes a manifold.

13. The apparatus of claim 11 wherein said rear zone includes an intermediate partition between said engine compartment of said vehicle and a passenger compartment in said vehicle.

* * * * *